US007665886B2

(12) United States Patent
Morris, Jr. et al.

(10) Patent No.: US 7,665,886 B2
(45) **Date of Patent: *Feb. 23, 2010**

(54) NOZZLE DEVICE USED FOR MULTIPHASE FLUID FLOW SIMULATION IN HIGH TEMPERATURE AND PRESSURIZED MIXING REACTORS

(76) Inventors: Joseph E. Morris, Jr., 10221 Tuscany Hills Way NW., Calgary, Alberta (CA) T3L 2G4; Catherine Morris, 10221 Tuscany Hills Way NW., Calgary, Alberta (CA) T3L 2G4

( * ) Notice: Subject to any disclaimer, the term of this patent is extended or adjusted under 35 U.S.C. 154(b) by 659 days.

This patent is subject to a terminal disclaimer.

(21) Appl. No.: 11/344,735

(22) Filed: Feb. 2, 2006

(65) Prior Publication Data

US 2007/0217286 A1 Sep. 20, 2007

(51) Int. Cl.
*B01F 7/16* (2006.01)

(52) U.S. Cl. ..... 366/262; 366/328.2; 416/91; 416/231 A

(58) Field of Classification Search ..... 366/163.2, 366/262, 328.2; 416/231 A, 91
See application file for complete search history.

(56) References Cited

U.S. PATENT DOCUMENTS

| | | | | | |
|---|---|---|---|---|---|
| 119,193 | A * | 9/1871 | Smith et al. | ..... | 366/328.2 |
| 122,075 | A * | 12/1871 | Still | ..... | 416/91 |
| 169,835 | A * | 11/1875 | PAyne | ..... | 416/91 |
| 1,779,181 | A * | 10/1930 | McDonald | ..... | 261/87 |
| 1,846,027 | A * | 2/1932 | Eaton et al. | ..... | 366/328.2 |
| 5,037,209 | A * | 8/1991 | Wyss | ..... | 366/246 |
| 5,156,778 | A * | 10/1992 | Small | ..... | 261/87 |
| 2004/0022122 | A1 * | 2/2004 | Kozyuk | ..... | 366/262 |
| 2007/0217287 | A1 * | 9/2007 | Morris et al. | ..... | 366/328.2 |

* cited by examiner

*Primary Examiner*—David L Sorkin
(74) *Attorney, Agent, or Firm*—Egbert Law Offices PLLC

(57) ABSTRACT

A mixing apparatus has a chamber, a shaft extending into the chamber, a motor drivingly interconnected to the shaft, a nozzle support affixed to the shaft and extending outwardly therefrom within the chamber, and a nozzle having an interior passageway affixed to the nozzle support such that the nozzle moves in the chamber as the motor drivingly rotates the shaft. The chamber has a multi-phase fluid therein. The nozzle moves through the fluid such that fluid is channeled through the interior passageway at a same rate that the nozzle moves through the fluid. Another nozzle can be affixed to the nozzle support diametrically opposite to the nozzle.

11 Claims, 2 Drawing Sheets

NOZZLE DEVICE USED FOR MULTIPHASE FLUID FLOW SIMULATION IN HIGH TEMPERATURE AND PRESSURIZED MIXING REACTORS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to mixing apparatus. More particularly, the present invention relates to apparatus used for mixing multi-phase fluid. Additionally, the present invention relates to rotating nozzles contained within the fluid for mixing the multi-phase fluid by a rotation of the nozzle within the reactor.

BACKGROUND OF THE INVENTION

There are a variety of reactors that are designed for the mixing of fluids. Often, these mixing reactors include various types of impellers, fan blades, turbines, and other mechanisms that can be rotated so that the fluid can be effectively mixed within the reactor. In many circumstances, these mixing reactors can contain multiple phases of fluids. For example, the mixing reactor can contain gas, oil and water as the multiple fluid phases. In order to effectively mix these phases, it is necessary to apply a turbulent force to the liquid within the reactor so as to create an intimate mixture within the reactor.

Every reactor has different design considerations. Some reactors are relatively large and the volume of fluids that must be mixed can vary in density and volume. Standard mixing apparatus associated with such reactors can be ineffective in mixing the fluids if the fluids have different components than that for which the reactor was designed. Often, an ineffective mixing will occur through the use of existing equipment. It is desirable to have a mixing reactor whereby the mixing component can be varied and altered so as to accommodate the various densities, types, desired mixtures and volumes of fluid within the reactor.

In the past, various patents have issued relating to such mixing apparatus and nozzles rotatable mounted in fluids. For example, U.S. Pat. No. 6,877,309, issued on Apr. 12, 2005 to S. K. Rhyne, describes an apparatus for generating electricity that utilizes at least one jet-type engine fueled with a fissile material. The nuclear-fuel jet engine is affixed to a connecting member that projects from a central rotatable shaft. The engine is positioned so that thrust generated by the jet engine causes the engine and the connecting member to travel in a radial direction around the longitudinal axis of the central shaft so as to rotate the central shaft. As the central shaft rotates, the rotational motion of the central shaft is transmitted to an energy conversion apparatus. The engines are mounted so as to face an opposite directions on opposite sides of the rotatable shaft.

U.S. Pat. No. 2,187,746 issued on Jan. 23, 1940 to L. Lefvre, describes a belt-driven rotational member with opposed reaction surfaces that are used to mix a fluid. Each of the reactor surfaces includes an opening through which the fluid will pass.

U.S. Pat. No. 4,577,460, issued on Mar. 25, 1986 to W. S. Wirsching, teaches a device that is used in the production of energy and which utilizes jet engines mounted on opposite ends of a shaft so as to drive the shaft through a fluid for the purposes of generating electricity. Each of the jet engines has an inlet and an outlet that face in opposite directions on opposite sides of the shaft. The fluid will flow through the interior of the jet engines as the jet engines rotate about the central axis.

U.S. Pat. Nos. 4,080,197, 5,431,860 and 3,092,678 describe various opposed-faced mixtures that use a central rotating shaft. For example, U.S. Pat. No. 4,080,197, issued on Mar. 21, 1978 to Meissner et al., describes a process for the production of lead from lead sulfide. Droplets of lead and slag from the pool are maintained throughout the headspace by droplet generating nozzles. U.S. Pat. No. 5,431,860, issued on Jul. 11, 1985 to Kozma et al., teaches a mixing apparatus that is capable of dispersing gas and a broth in which a number of propeller mixers are provided on a vertically extending shaft. U.S. Pat. No. 3,092,678, issued on Jun. 4, 1963 to E. Braun, teaches an apparatus for gasifying liquids which includes a propeller element rotatably mounted on a central shaft.

It is an object of the present invention to provide a mixing apparatus that facilitates longitudinal/normal fluid flows.

It is another object of the present invention to provide a mixing apparatus that channels the fluid through the nozzle passageway at the same rate that the nozzle moves through the fluid.

It is another object of the present invention to provide a mixing apparatus that can be designed to simulate multi-phase fluid flow dynamics and to suit any type of reactor or design specifications.

It is another object of the present invention to provide a mixing apparatus that is adaptable to a wide array of fluid densities, types, volumes and viscosities with no actual limitations on wall shear stress levels produced.

It is still a further object of the present invention to provide a mixing apparatus that is relatively easy to use, relatively inexpensive and relatively easy to manufacture.

These and other objects and advantages of the present invention will become apparent from the reading of the attached specification and appended claims.

BRIEF SUMMARY OF THE INVENTION

The present invention is a mixing apparatus that comprises a chamber, a shaft extending into the chamber, a motor drivingly interconnected to the shaft so as to rotate the shaft in the chamber, a nozzle support affixed to the shaft and extending outwardly therefrom within the chamber, and a first nozzle having an interior passageway with an inlet and an outlet. The first nozzle is affixed to the nozzle support such that the first nozzle moves in the chamber as the motor drivingly rotates the shaft.

In the present invention, the chamber has a multi-phase fluid therein. The nozzle moves through this multi-phase fluid such that the fluid is channeled through the interior passageway at a same rate that the nozzle moves through the multi-phase fluid.

A second nozzle also is provided having an interior passageway. This interior passageway of the second nozzle has an inlet and an outlet. The second nozzle is affixed to the nozzle support such that the second nozzle moves in the chamber as the motor drivingly rotates the shaft. The second nozzle is positioned diametrically opposite the first nozzle relative to the shaft. The shaft extends vertically into the chamber. The nozzle support extends transversely to the shaft. The first and second nozzles are positioned in a common horizontal plane within the chamber. The inlet of the first nozzle faces in an opposite direction to that of the inlet of the second nozzle.

Each of the nozzles of the present invention has an identical configuration. In particular, the nozzle includes a tubular body with a frustoconical section extending so as to widen toward the outlet. The inlet opens to one end of the nozzle and the outlet opens adjacent an opposite end of the nozzle. The opposite end of the nozzle has a metal coupon affixed thereto. The metal coupon is a square planar piece. The metal coupon has corners affixed to the opposite end of the first nozzle. The metal coupon has a edges between the corners defining outlet spaces with the opposite end of the nozzle. The nozzle also includes a locking ring affixed to the opposite end thereof. The metal coupon is secured to this locking ring.

The nozzle also has an inlet longitudinal metal coupon extending around the interior passageway at a location inwardly of the inlet to the interior passageway. The inlet of the interior passageway is tapered so as to narrow toward the interior passageway and "funnel" fluids toward the interior passageway. A spacer is affixed around the nozzle such that the inlet longitudinal metal coupon has an end abutting the spacer.

The nozzle support has a first clamp at one end thereof and a second clamp at an opposite end thereof. The first clamp receives the first nozzle therein. The second clamp receives the second nozzle therein.

DETAILED DESCRIPTION OF THE INVENTION

Figure 1:
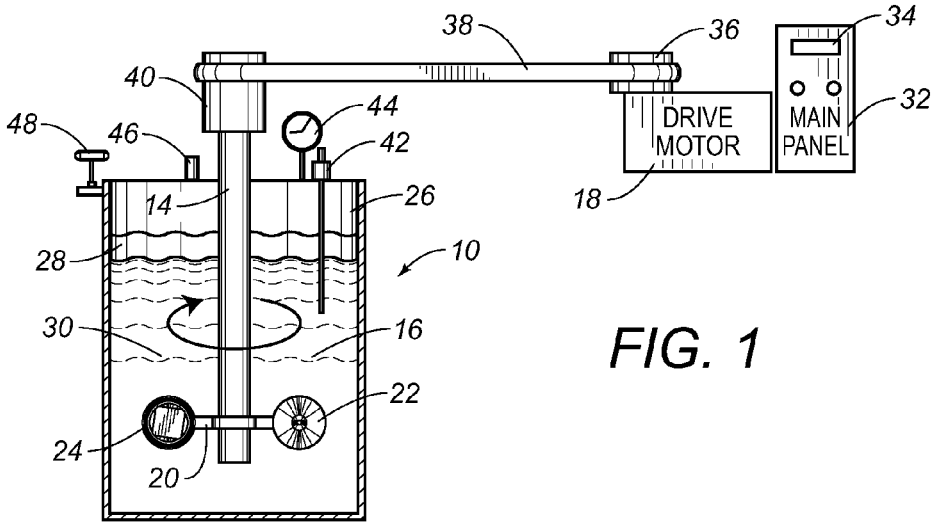
FIG. 1 is a diagrammatic illustration of the mixing apparatus in accordance with the preferred embodiment of the present invention

Referring to FIG. 1, there is shown the mixing apparatus 10 in accordance with the preferred embodiment of the present invention. The mixing apparatus 10 includes a chamber 12, a shaft 14 extending into the interior 16 of chamber 12, a motor 18 drivingly interconnected to the shaft 14, a nozzle support 20 affixed to the shaft 14 and extending outwardly therefrom within the chamber 12, and a first nozzle 22 affixed to the nozzle support 20 within the chamber 12. A second nozzle 24 is connected to the nozzle support 20 diametrically opposite to the first nozzle 22. The nozzles 22 and 24 are affixed to the nozzle support 20 such that the nozzles 22 and 24 move in the chamber 12 as the motor 18 drivingly rotates the shaft 14.

In FIG. 1, it can be seen that there is a multi-phase fluid within the interior 16 of the chamber 12. The multi-phase fluid can includes a gas phase 26, an oil phase 28 and a water phase 30. Within the concept of the present invention, various other multi-phase fluid arrangements can also be utilized. As will be described hereinafter, it is only necessary to reconfigure each of the nozzles 22 and 24 so as to establish an effective mixing of the fluids within the interior 16 of the chamber 12.

As can be in FIG. 1, the drive motor 18 is connected to a main panel 32. The main panel 32 can include a tachometer 34 so that the user can monitor the rotational speed of the shaft 14. The drive motor 18 will have a shaft connected to a suitable pulley or sheave 36. A belt drive 38 extends from pulley 36 to another pulley 40. Pulley 40 is directly connected to the shaft 14 and is located outside of the chamber 12 directly above the shaft 14. When the drive motor 18 is actuated, the pulley 36 will rotate so as to cause a corresponding movement of the belt 38 and a rotation of the pulley 40. This, in turn, creates a rotation of the shaft 14 such that the nozzle support 20 cause the nozzles 22 and 24 to rotate within the fluid on the interior 16 of the chamber 12. The shaft 14 extends vertically downwardly into the chamber 12 from the pulley 40. The nozzle support 20 extends transversely outwardly of the vertical shaft 14. The nozzles 22 and 24 extend in a horizontal plane within the interior 16 of the chamber 12.

As can be seen in FIG. 1, various other components can be connected to the chamber 12. For example, a temperature gauge 42 provides an indication of the temperature of the fluid within the interior 16 of chamber 12. A pressure gauge 44 is mounted outwardly of the chamber 12 so as to be indicative of the pressure of the interior of the chamber. A gas inlet 46 is provided at the top of the chamber 12. A reactor gas outlet/sample port 48 extends outwardly of a side of the chamber 12.

Figure 2:
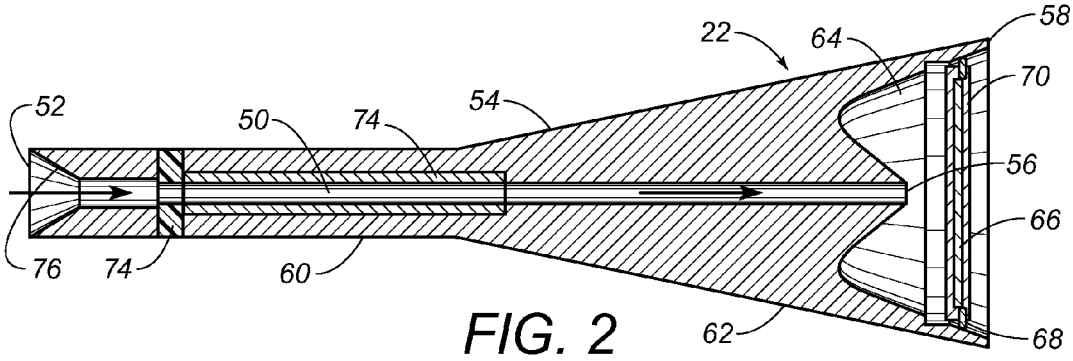
FIG. 2 is a cross-sectional view of a nozzle as used with the mixing apparatus of the present invention.

FIG. 2 shows a detailed view of the nozzle 22. The illustration of FIG. 2 is equally applicable to the nozzle 24 since the nozzles 22 and 24 are identical. As can be seen, the nozzle 22 includes an interior passageway 50 extending longitudinally therethrough. The interior passageway 50 has an inlet 52 at one end of the body 54 of nozzle 22. Similarly, the interior passageway 50 includes an outlet 56 at an end adjacent to the opposite end 58 of the body 54. The body 54 includes a tubular portion 60 extending toward the inlet 52. A frustroconical section 62 widens from the tubular portion 60 toward the end 58 of the body 54. The frustroconical section 62 will begin to widen generally adjacent to the center of the body 54 of nozzle 22.

As can be seen in FIG. 2, the outlet 56 opens to a widened area 64 inwardly of the end 58. Importantly, in the present invention, a metal coupon 66 will extend across the widened area 64 at the end 58 of body 54. The metal coupon 66 will be described hereinafter. A gasket 68 secures a locking ring 70 to the end 58 of the body 54. An inlet longitudinal metal coupon 72 will extend around the interior passageway 50 inwardly of the inlet 52. The longitudinal metal ring is positioned around the interior passageway 50 and extends therealong. A spacer 74 is affixed to the body 54 such that the end of the inlet longitudinal metal coupon 72 will abut the spacer 74. The spacer 74 can be in the nature of a TEFLON (TM) spacer.

The inlet 52 includes a tapered interior 76. The tapered interior 76 widens at the inlet 52 and will narrow toward the interior passageway 50. As such, this tapered section 76 will tend to "funnel" the fluids toward the interior passageway 50.

Figure 3:
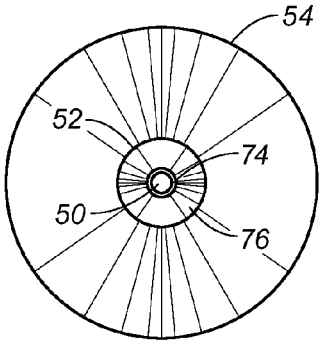
FIG. 3 is an end view showing the inlet of the nozzle of the mixing apparatus of the present invention.

FIG. 3 shows an end view of the inlet 52 of the body 54. In particular, it can be seen that the tapered section 76 will extend inwardly toward the interior passageway 50. Spacer 74 is positioned within the interior of the body 54 so as to provide a surface onto which the inlet longitudinal metal coupon 72 abuts.

Figure 4:
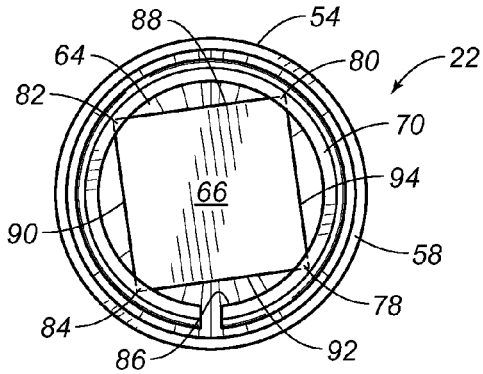
FIG. 4 is an opposite end view of the outlet of the nozzle of the mixing apparatus of the present invention.

FIG. 4 illustrates how the metal coupon 66 is secured within the end 58 of the body 54 of nozzle 22. The metal coupon 66 is a square planar piece of metal. The metal coupon 66 has corners 78, 80, 82 and 84 affixed within the locking ring 70. Locking ring 70 is secured within a gasket, or against a gasket, at the end 58 of the body 54. The widened portion 64 of the outlet 56 of the interior passageway 50 has a periphery 86. The locking ring 70 is secured to this periphery 86. It should be noted that the edge 88 of the metal coupon 66 will define an outlet space with the periphery 86. Similarly, edge 90 (between corners 82 and 84), edge 92 (between corners 84 and 78) and edge 94 (between corners 78 and 80) also define outlet spaces with respect to the periphery 86. As such, the size of the metal coupon 66 can be suitably dimensioned so that the fluid flow outlet from the passageway 50 will be as desired. Through the use of the locking ring 70, the metal coupon 66 can be adapted, in many ways, so as to achieve the desired results.

Figure 5:
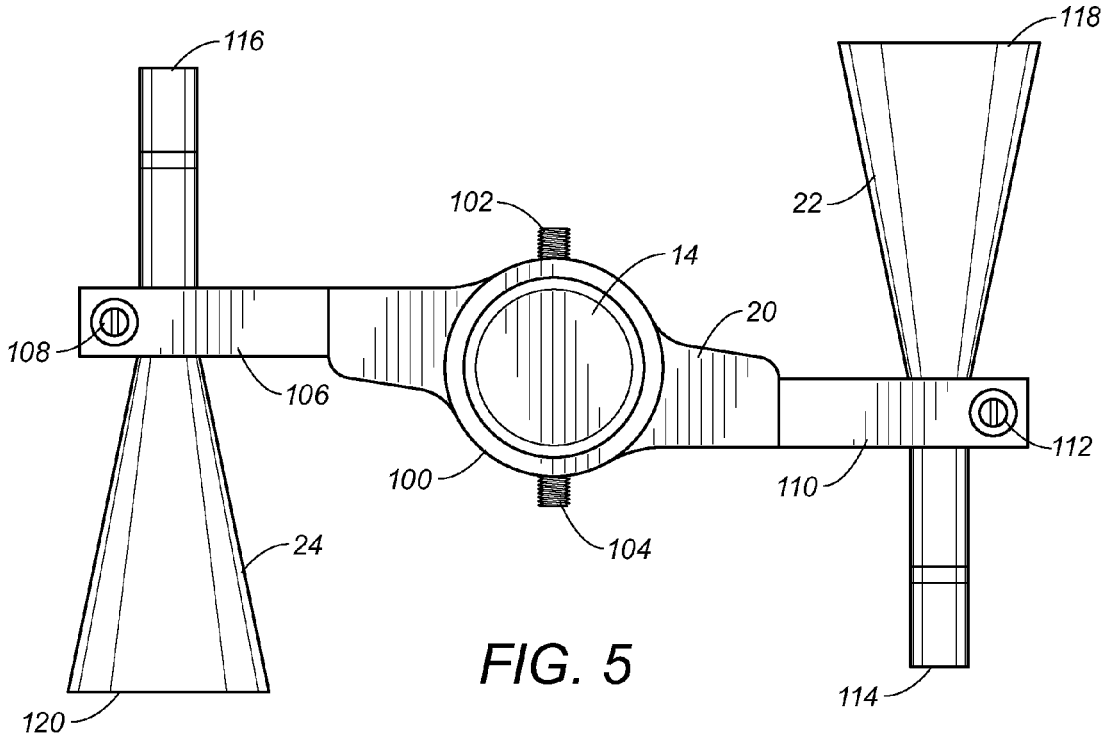
FIG. 5 is a plan view showing the attachment of the nozzles on opposite sides of the shaft of the mixing apparatus of the present invention.

FIG. 5 illustrates the nozzle support 20 as secured to the shaft 14 for the purposes of maintaining the nozzles 22 and 24 in their desired orientation within the chamber 12. Initially, it can be seen that the nozzle support 20 includes a collar 100 that is affixed around the outer periphery of the shaft 14. Set screws 102 and 104 are provided so as to securely affix the collar 100, along with the associated nozzle support 20, to the shaft 14. A clamp 106 will extend outwardly of the nozzle support 20 so as to receive the nozzle 24 therein. A suitable clamping screw 108 can be loosened or tightened, as desired, so as to securely affix the exterior surface of the nozzle 24 within the clamp 106. Another clamp 110 extends diametrically outwardly of the collar 100 from that the clamp 106. Once again, another clamping screw 112 is provided so as to allow the user to easily secure the nozzle 22 in a desired position within the clamp 110. In FIG. 5, it can be seen that the inlet 114 of nozzle 22 is opposite the inlet 116 of nozzle 24. Similarly, the outlet 118 of nozzle 22 is opposite to that of the outlet 120 of nozzle 24. As the nozzle support 20 rotates with the rotation of the shaft 14, the nozzles 22 and 24 will follow each other in a path around the orientation of shaft 14.

Figure 6:
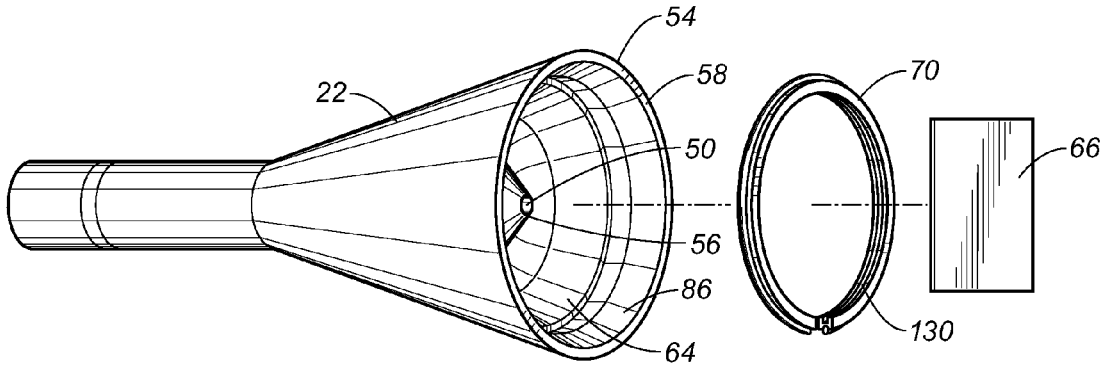
FIG. 6 is an exploded view showing the arrangement of the locking ring and metal coupon as affixed to the outlet of the nozzle of the mixing apparatus of the present invention.

FIG. 6 shows the end 58 of the body 54 of the nozzle 22. As can be seen, the outlet 56 of the interior passageway 50 opens to the widened area 64. The end 58 includes a suitable periphery 86.

The locking ring 70 has a generally split O-shaped configuration. As such, the ring 70 can be suitably flexible so as to be inserted within the periphery 86 at the end 58 of body 54. The split nature of the ring 70 will cause the ring 70 resiliently spread outwardly when inserted within end 58 of the body 54. The metal coupon 66 can be secured within the interior edge 130 of the locking ring 70 prior to insertion within the body 54.

In the present invention, the nozzle device is attached to the rotating shaft within pressure reactor systems. As the rotating shaft within the pressure reactor rotates, so does the affixed nozzle components about a fixed axis. The nozzle devices are designed to channel the fluid through the nozzle interior passageway at the same rate that the nozzles are cutting/moving through the fluid. In order to determine the actual fluid velocity through the nozzle interior passageway it should be calculated that Velocity=(Rotational Speed)×(Radial Distance from the Axis of Rotation). Standard equations can be utilized for determining fluid flow through the pipeline and/or shear stress components. The wall shear effects produced at the nozzle interior passageway due to completely hydraulic-entrained fluid velocity/movement through the nozzle interior passageway (with nozzle movements static) produces the same wall shear effect/impact of the interior passageway wall as if the nozzle was designed to slice through the fluid at the same velocity. The nozzles associated with the present invention can be designed to suite any size of reactor or system design specifications.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A mixing apparatus for a multi-phase fluid at constant temperature and pressure, eliminating siphoning, vacuum, cavitation, pumping and differential pressure factors, said mixing apparatus comprising:

a chamber;

a shaft extending into said chamber;

a motor drivingly interconnected to said shaft so as to rotate said shaft in said chamber;

a nozzle support affixed to said shaft and extending outwardly therefrom within said chamber; and a first nozzle having a body with an interior passageway, said interior passageway having an inlet at one end of said body and an outlet at or adjacent to an opposite end of said body, said first nozzle affixed to said nozzle support such that said first nozzle moves in said chamber as said motor drivingly rotates said shaft, said body being a tubular body with a tube section and a frustoconical section extending so as to widen toward said outlet from said tube section, said first nozzle moving through a hydraulic fluid of said multi-phase fluid such that said hydraulic fluid is channeled through said interior passageway at a same rate that said nozzle moves through said hydraulic fluid, said body having an longitudinal metal coupon extending around said interior passageway inwardly of said inlet of said interior passageway, said inlet of said interior passageway being tapered so as to narrow toward said interior passageway.

2. The mixing apparatus of claim 1, further comprising:

a metal coupon affixed to said body at said opposite end and over a portion of said outlet.

3. The mixing apparatus of claim 2, said metal coupon being a square planar piece, said metal coupon having corners affixed to said opposite end of said body, said metal coupon having edges between said corners defining outlet spaces with said opposite end of said body.

4. The mixing apparatus of claim 1, said body having a locking ring affixed to said opposite end thereof, said metal coupon secured to said locking ring.

5. The mixing apparatus of claim 1, further comprising:

a second nozzle having a body with an interior passageway, said interior passageway having an inlet at one end of said body and an outlet at or adjacent to an opposite end of said body, said second nozzle affixed to said nozzle support such that said second nozzle moves in said chamber as said motor drivingly rotates said shaft, said body being a tubular body with a tube section and a frustoconical section extending so as to widen toward said outlet from said tube section, said second nozzle moving through said hydraulic fluid through said first nozzle of said multi-phase fluid such that said hydraulic fluid is channeled through said interior passageway at a same rate that said nozzle moves through said hydraulic fluid, said body having an longitudinal metal coupon extending around said interior passageway inwardly of said inlet of said interior passageway, said inlet of said interior passageway being tapered so as to narrow toward said interior passageway.

6. The mixing apparatus of claim 5, said second nozzle positioned diametrically opposite said first nozzle relative to said shaft.

7. The mixing apparatus of claim 5, said shaft extending vertically into said chamber, said nozzle support extending transversely to said shaft, the first and second nozzles positioned in a common horizontal plane.

8. The mixing apparatus of claim 5, said inlet of said first nozzle facing in an opposite direction to that of said inlet of said second nozzle.

9. The mixing apparatus of claim 5, said nozzle support having a first clamp at one end thereof and a second clamp at an opposite end thereof, said first clamp receiving said first nozzle therein, said second clamp receiving said second nozzle therein.

10. The mixing apparatus of claim 5, said first nozzle having a spacer affixed therearound, said inlet longitudinal metal coupon having an end abutting said spacer.

11. The mixing apparatus of claim 1, said outlet of said interior passageway expanding into a cavity at an end of said frustoconical section.

* * * * *